US005779126A

United States Patent [19]

Chun

[11] Patent Number: 5,779,126

[45] Date of Patent: Jul. 14, 1998

[54] SYSTEM FOR SUPPORTING TORQUE

[75] Inventor: Gil-Hwan Chun, Haminkeln, Germany

[73] Assignee: A. Friedr. Flender AG, Bocholt, Germany

[21] Appl. No.: 741,517

[22] Filed: Oct. 31, 1996

[30] Foreign Application Priority Data

Nov. 21, 1995 [DE] Germany ..... 195 43 364.5

[51] Int. Cl.[6] ..... B65H 20/00

[52] U.S. Cl. ..... 226/187; 226/183

[58] Field of Search ..... 226/183, 185, 226/187

[56] References Cited

U.S. PATENT DOCUMENTS

| | | | |
|---|---|---|---|
| 3,317,104 | 5/1967 | Hughes et al. | 226/183 |
| 3,328,851 | 7/1967 | Whitehurst | 226/183 X |
| 3,447,730 | 6/1969 | Jeannette | 226/187 X |
| 3,715,068 | 2/1973 | Clarke et al. | 226/187 X |
| 4,205,771 | 6/1980 | Samokovliski et al. | 226/187 X |

*Primary Examiner*—Michael Mansen
*Attorney, Agent, or Firm*—Max Fogiel

[57] ABSTRACT

Two rollers (1 & 2) rotate in opposite directions. One roller is stationary and the other travels toward and away from it along a bed. One roller (1) has a journal (5) at one end and the other roller a journal (6) at the same end. A transmission (7) is mounted over the first journal and another transmission (8) over the second journal. Two pairs of torque supports are fastened to the transmission housings. The torque supports (9 & 12) fastened to the housing of the transmission associated with the first roller are connected by a tierod (17) at two points (13 & 15). The torque supports (10 & 11) fastened to the housing of the transmission associated with the second roller are connected by a tierod (18) at two other points (14 & 16). All the points of articulation are on one side of a midplane (19) extending through the longitudinal axes of the rollers.

4 Claims, 2 Drawing Sheets

SYSTEM FOR SUPPORTING TORQUE

BACKGROUND OF THE INVENTION

The present invention concerns a system for supporting torque in two oppositely rotated rollers.

The system shunts together the opposing torques deriving from two journal-mounted transmissions by way of torque supports and tierods. If the driving torques are equal, accordingly, no additional forces will be exerted on the transmission bearing or roller bearing. At a torque detrimental to the rollers the only forces will be on the order of magnitude of the difference between the bearing-drive torques.

The supports and tierods employed in one known system for supporting torque (German Patent 4 019 363) are identical in design. The tierods connect the supports directly. The points of articulation of one of the tierods are located along with the torque supports on one side of a line between the rollers' axis of rotation and the points of articulation of the other tierod on the other side of the line. This system of supporting torque is simple, results in few or no additional forces, and occupies little space. When subjected to load, however, one of the tierods undergoes tension and the other design-dictated compression. A component undergoing tension can be unambiguously dimensioned, whereas a possible distortion must be taken into consideration in a component undergoing compression.

SUMMARY OF THE INVENTION

The object of the present invention is a generic system of supporting torque that can cope more effectively with the forces it is subjected to.

Since all points of articulation are on the same side of the midplane, both tierods undergo strain, as desired, and can accordingly be unambiguously dimensioned. Furthermore, the space on the side to the transmission facing away from the support can be exploited for accommodating accessories when necessary. Otherwise, the overall machinery can be more compact. Finally, the nip between the two rollers can be very small and can even be shifted from one side to the other to some extent.

BRIEF DESCRIPTION OF THE DRAWINGS

One embodiment of the present invention will now be specified with reference to the accompanying drawing, in which.

DESCRIPTION OF THE PREFERRED EMBODIMENTS

Figure 1:
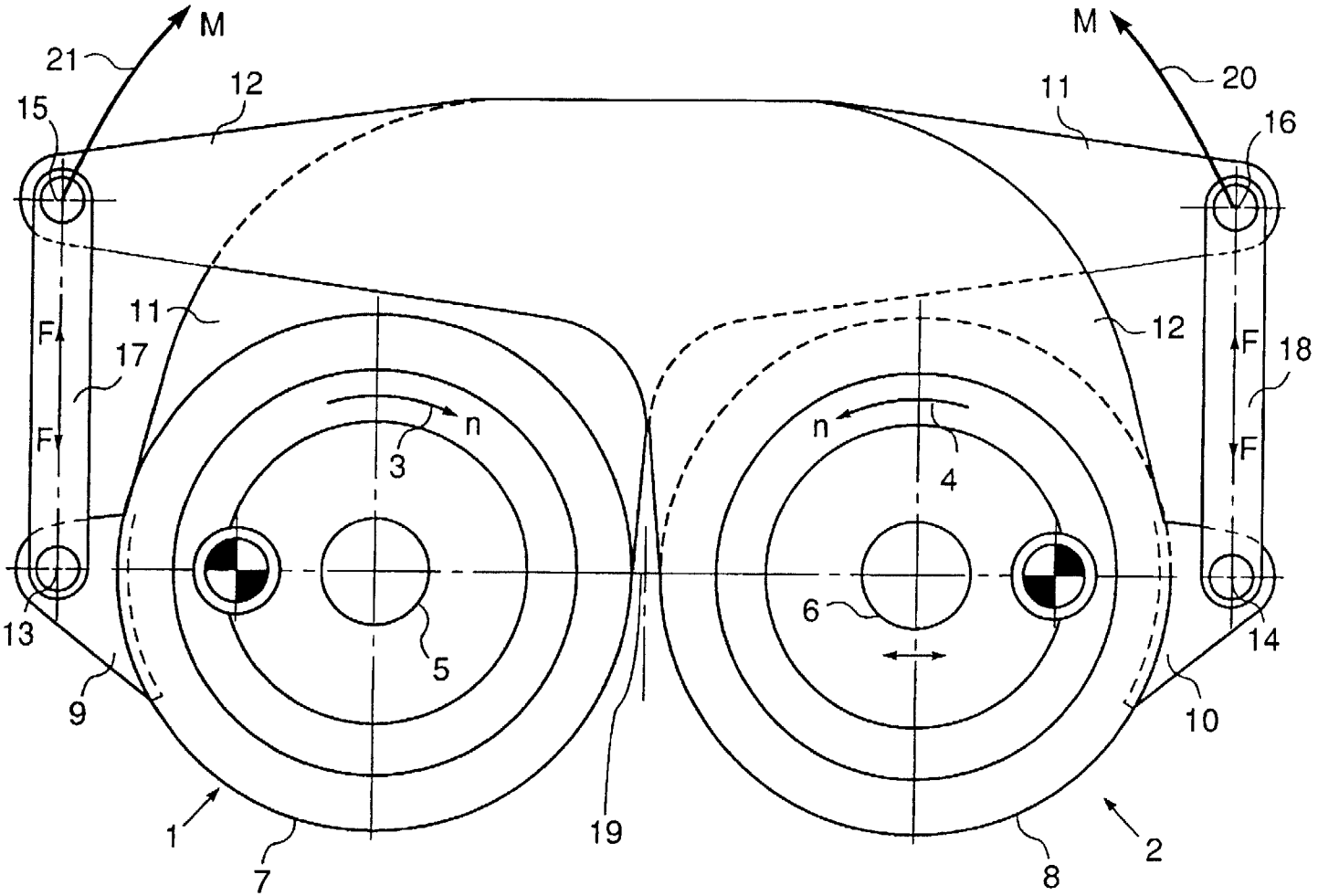
FIG. 1 is a lateral view of two rollers and a system of supporting torque.
Figure 2:
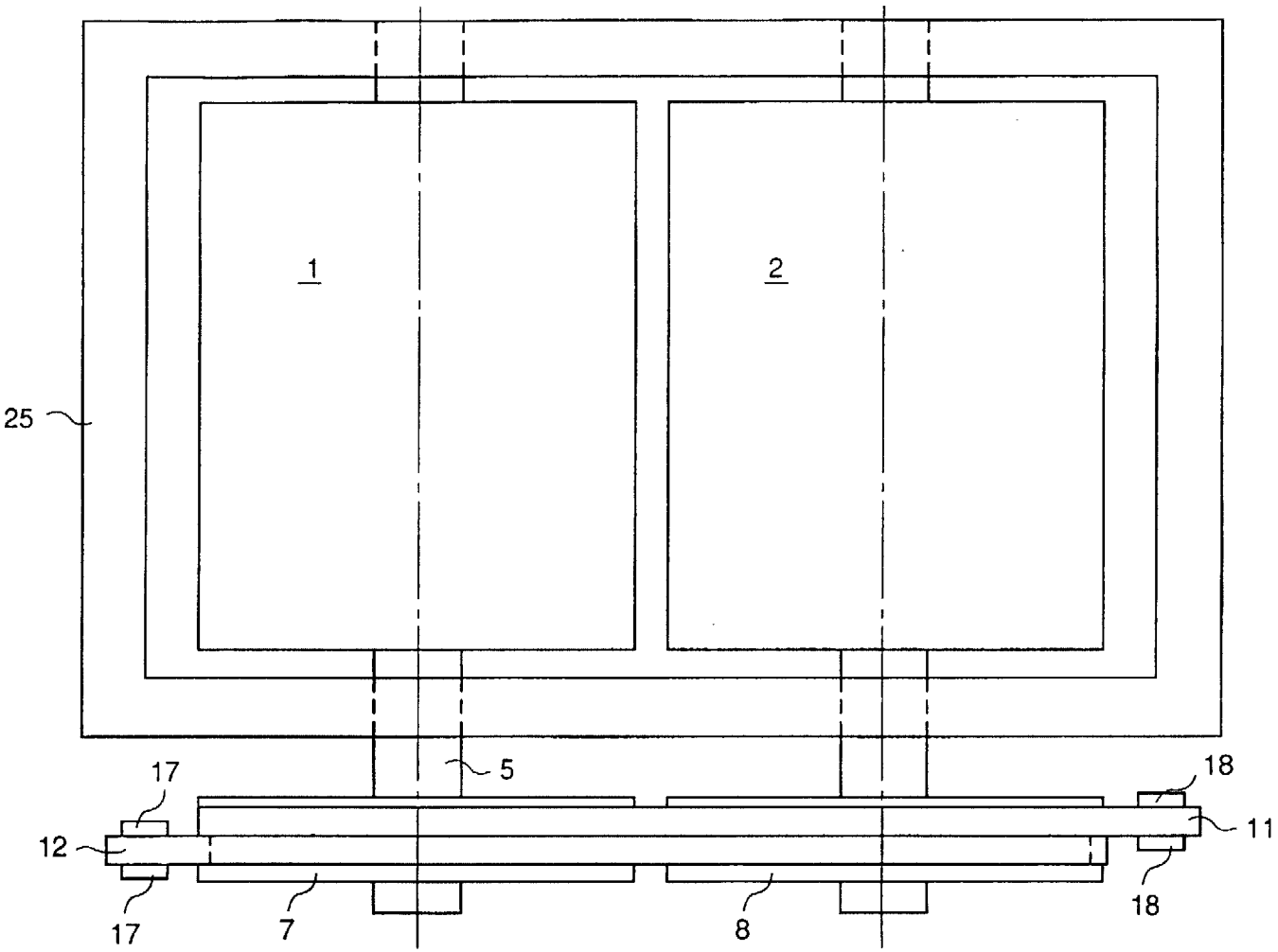
FIG. 2 is a top view of the arrangement of FIG. 1.

Two horizontally aligned rollers 1 and 2 are part of a mill. Since the rollers are separated by a nip. The material being milled is introduced into the nip from above. To vary the width of the nip and to compensate for wear on the surfaces of the rollers, roller 1 is mounted stationary and roller 2 can be displaced toward and away from it along an unillustrated bed. Rollers 1 and 2 rotate in directions 3 and 4 that promote the intake of material into the nip.

Roller 1 has a journal 5 at one end and roller 2 a journal 6 at the end on the same side of the overall machinery. A transmission 7 is mounted over journal 5 and a transmission 8 over journal 6. The transmissions are preferably hollow-shaft planetary transmissions.

Four torque supports are fastened to the transmission housings. A shorter torque support 9 is mounted against the outer surface of transmission 7 and a similar torque support 10 to the outer surface of transmission 8. A longer torque support 11 extends around roller 1 to just above shorter torque support 9 and a similar torque support 12 around roller 2 to just above second shorter torque support 10. The shorter torque support 9 in transmission 7 is articulated to the longer torque support 12 in transmission 8 by a tie rod 17 at points of articulation 13 and 15, and the shorter torque support 10 in transmission 8 to the longer torque support 11 in transmission 7 by a tierod 18 at points 14 and 16. Tierods 17 and 18 constitute levers with a point of articulation at each end. All the points 13, 14, 15, and 16 of articulation are on the same side of an imaginary midplane 19 extending through longitudinal axes of rollers 1 and 2. The points 13 and 14 of articulation between the shorter torque supports and the tierods can be in the vicinity of midplane 19. Torque supports 9, 10, 11, and 12 and tierods 17 and 18 extend along the same side of transmissions 7 and 8. If rollers 1 and 2 are horizontal, points 13 and 14 should be in the vicinity of midplane 19 and points 15 and 16 above it.

If a reactive torque is transmitted during operation from one transmission to the other, the point of articulation 15 or 16 between a longer torque support and its associated tierod will shift in direction 20 or 21. This motion will generate, due to the system of supporting torque along one side, only tension in tierods 17 and 18. Positioning the system of supporting torque on one side also leaves room below midplane 19 to accommodate accessories within the machinery. The overall system can alternatively be more compact. The system of supporting torque in accordance with the present invention can also be employed with non-horizontal rollers 1 and 2 that rotate toward each other. The tierods 17 and 18 in such instances will also undergo only tension.

In summary, the present invention is concerned with a system of supporting torque in two oppositely rotated rollers. A first roller 1 is mounted stationary and a second roller 2 is displaceable toward and away from the first roller along a bed 25. The first and second rollers each have a journal 5, 6, respectively, at the same end of the rollers. A transmission 7, 8 is mounted over each journal, and torque supports 9–12 are fastened to the transmissions. The torque supports, furthermore, are connected by tie rods 17, 18 at two points 13–16 of articulation. The points of articulation for each tie rod are on one side of a mid plane 19 that extends through the axes of the rollers.

Furthermore, a point 13 or 14 of articulation associated with each tie rod 17 or 18, is in the vicinity of the mid plane 19.

The rollers 1, 2 may be horizontal, and their directions of rotation function to move material downward between them, and the points of articulation may be above the mid plane 19.

I claim:

1. A system for supporting torque in two oppositely-rotated rollers, comprising: a first roller mounted stationarily; a second roller displaceable toward and away from said first roller along a bed; said first and second rollers having axes; a journal in each roller at same ends of said first roller and said second roller; transmission means mounted over each journal; torque supports fastened to said transmission means; tie rods connected to said torque supports at two points of articulation on each tie rod; said two points of articulation on each tie rod being both on one side of a midplane extending through said axes of said rollers.

2. A system as defined in claim 1, wherein one point of articulation associated with each tie rod is adjacent said midplane.

3. A system as defined in claim 1, wherein said first and second rollers are horizontal and have a space between them, said rollers having directions of rotation for moving downward material entering said space between said rollers, said points of articulation being above said midplane.

4. A system for supporting torque in two oppositely-rotated rollers, comprising: a first roller mounted stationarily; a second roller displaceable toward and away from said first roller along a bed; said first and second rollers having axes; a journal in each roller at same ends of said first roller and said second roller; transmission means mounted over each journal; torque supports fastened to said transmission means; tie rods connected to said torque supports at two points of articulation on each tie rod; said two points of articulation on each tie rod being both on one side of a midplane extending through said axes of said rollers; one point of articulation associated with each tie rod being adjacent said midplane; said first and second rollers being horizontal and having a space between them, said rollers having directions of rotation for moving downward material entering said space between said rollers, said points of articulation being above said midplane.

* * * * *